US010083674B2

(12) United States Patent
Gu et al.

(10) Patent No.: US 10,083,674 B2
(45) Date of Patent: Sep. 25, 2018

(54) DISPLAY DEVICE AND METHOD OF DRIVING THE SAME

(71) Applicant: Samsung Display Co., Ltd., Yongin-si, Gyeonggi-do (KR)

(72) Inventors: Bon Seog Gu, Yongin-si (KR); Jong Soo Kim, Yongin-si (KR); Se Hyuk Park, Yongin-si (KR); Myoung Seop Song, Yongin-si (KR); Myung Ho Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 73 days.

(21) Appl. No.: 15/251,988

(22) Filed: Aug. 30, 2016

(65) Prior Publication Data

US 2017/0154603 A1 Jun. 1, 2017

(30) Foreign Application Priority Data

Nov. 27, 2015 (KR) ..... 10-2015-0167194

(51) Int. Cl.

| | |
|---|---|
| ***G09G 5/10*** | (2006.01) |
| ***G09G 3/3233*** | (2016.01) |
| ***G09G 3/20*** | (2006.01) |
| ***G09G 3/3283*** | (2016.01) |

(52) U.S. Cl.

CPC ..... *G09G 5/10* (2013.01); *G09G 3/2003* (2013.01); *G09G 3/3233* (2013.01); *G09G 3/3283* (2013.01); *G09G 2300/0452* (2013.01); *G09G 2300/0469* (2013.01); *G09G 2320/0233* (2013.01); *G09G 2320/0242* (2013.01); *G09G 2320/045* (2013.01); *G09G 2330/10* (2013.01)

(58) Field of Classification Search

None

See application file for complete search history.

(56) References Cited

U.S. PATENT DOCUMENTS

| | | | | |
|---|---|---|---|---|
| 2014/0085274 | A1* | 3/2014 | Lewis | G09G 3/3433 345/204 |
| 2015/0048999 | A1* | 2/2015 | Hsieh | G06F 3/1423 345/1.1 |
| 2016/0005383 | A1* | 1/2016 | Lee | G09G 3/3291 345/690 |

* cited by examiner

*Primary Examiner* — Nicholas Lee

(74) *Attorney, Agent, or Firm* — Lewis Roca Rothgerber Christie LLP

(57) ABSTRACT

A display device includes a plurality of front emission pixels each including a display panel including a plurality of front emission pixels each including a switching element, and a rear emission pixel, a sensor configured to sense whether the front emission pixels are degraded and to generate degradation information, and a controller configured to compensate for a degraded light source of a degraded front emission pixel of the front emission pixels according to the degradation information, and to control an ON/OFF state of the switching element of the degraded front emission pixel according to the degradation information.

11 Claims, 5 Drawing Sheets

DISPLAY DEVICE AND METHOD OF DRIVING THE SAME

CROSS-REFERENCE TO RELATED APPLICATION

This application claims priority to, and the benefit of, Korean Patent Application No. 10-2015-0167194, filed on Nov. 27, 2015, in the Korean Intellectual Property Office, the entire content of which is incorporated herein by reference in its entirety.

BACKGROUND

1. Field

Aspects of the present invention relate to a display device, and a method of driving the same.

2. Description of the Related Art

Computer monitors, televisions, mobile phones, and the like, which are widely used, generally have a display device. Here, display devices for displaying images using digital data include a cathode ray tube (CRT), a liquid crystal display (LCD), a plasma display panel (PDP), an organic light emitting display device, and the like.

Among the display devices, the organic light emitting display device displays an image using an organic light emitting diode (OLED) by generating light according to recombination of electrons and holes. The organic light emitting display device may obtain a high color gamut due to characteristics of self-light emission material, and because a light emission area of pixels is reduced as resolution increases, a change in total power consumption of a panel is insignificant. Also, the organic light emitting display device has fast response speed and low power consumption at high resolution, as compared with a liquid crystal display (LCD) device.

However, due to the characteristics of a self-light emission display panel, the organic light emitting display device may have problems in that an image of desired luminance cannot be displayed due to a change in efficiency according to a degradation of a material (i.e., a degradation of an OLED), and a residual image may be generated. Actually, the OLED is degraded according to the passage of time, and light having gradually lower luminance is generated to correspond to the same data signal.

Thus, a method of compensating for degradation by measuring a current flowing in a light emitting device, or by measuring brightness of a pixel, may be considered. However, when the method of compensating for degradation by adding input data and compensation data in a degraded pixel is used, a degradation of the corresponding pixel may be accelerated. Also, when luminance of another pixel is lowered on the basis of the degraded pixel, luminance of the entire display panel may be reduced, and lifespan of the corresponding pixel may remain as it is.

SUMMARY

Aspects of embodiments of the present invention are directed to a display device capable of lengthening lifespan of a display panel by compensating for luminance through another device when a light emitting device is degraded, and a method of driving the same.

Technical subjects of the present invention are not limited to the foregoing technical subjects, and any other technical subjects not mentioned will be clearly understood by a skilled person in the art from the following description.

According to some embodiments of the present invention, there is provided a display device including: a display panel including a plurality of front emission pixels each including a switching element, and a rear emission pixel; a sensor configured to: sense whether the front emission pixels are degraded; and generate degradation information; and a controller configured to: compensate for a degraded light source of a degraded front emission pixel of the front emission pixels according to the degradation information; and control an ON/OFF state of the switching element of the degraded front emission pixel according to the degradation information.

In an embodiment, the rear emission pixel includes: a red subpixel; a green subpixel; and a blue subpixel, and the controller is configured to control emission of light from at least one subpixel of the rear emission pixel according to the degradation information.

In an embodiment, the controller is configured to control the switching element of the degraded front emission pixel during a period in which at least one subpixel of the rear emission pixels emits light.

In an embodiment, the rear emission pixel includes: a red subpixel; a green subpixel; and a blue subpixel, and the controller is configured to control light emission of the subpixels of the rear emission pixel.

In an embodiment, the controller is configured to control the switching element of the degraded front emission pixel during a period in which a subpixel of the rear emission pixel emits light by an amount of color for compensating the degradation of the degraded front emission pixel according to the degradation information.

In an embodiment, the switching element includes a micro electromechanical system (MEMS).

In an embodiment, the display panel includes: a front emission panel including the front emission pixels; a rear emission panel including the rear emission pixel; a diffusion sheet under the front emission panel and the rear emission panel; and a reflection plate under the diffusion sheet.

In an embodiment, the rear emission pixel includes: a red subpixel; a green subpixel; and a blue subpixel, wherein the switching element defines an opening, and, when subpixels of the front emission pixels are all degraded, the controller is configured to control light emission of a subpixel of the rear emission pixel corresponding to the subpixels of the front emission pixels.

In an embodiment, the degradation information includes: information regarding the degraded front emission pixel; and information regarding a degree of degradation of the degraded front emission pixel.

In an embodiment, each of the front emission pixels further includes an organic light emitting diode (OLED).

According to some embodiments of the present invention, there is provided a method of driving a display device including a plurality of front emission pixels that are configured to emit light toward an upper side of a display and that include a switching element configured to control a passage of light, and also including a rear emission pixel configured to emit light to a lower side of the display, the method including: sensing degradation information of the front emission pixels; controlling light emission of the rear emission pixel to correspond to the degradation information; and controlling an ON state or an OFF state of the switching element according to the sensed degradation information.

In an embodiment, the sensing of the degradation information includes sensing degradation information of an OLED in each of a front red subpixel, a front green subpixel, and a front blue subpixel of the front emission pixels.

In an embodiment, the controlling of the light emission of the rear emission pixel includes enabling at least one of a rear red subpixel, a rear green subpixel, and a rear blue subpixel of the rear emission pixel to emit light corresponding to the sensed degradation information.

In the display device and the method of driving the same according to an embodiment of the present invention, when degradation occurs in a light emitting device, brightness is compensated through another device to lengthen lifespan of a display panel.

Aspects and effects of the present invention that may be obtained in the present invention are not limited to the foregoing effects, and any other effects not mentioned herein may be easily understood by a person skilled in the art from the present disclosure and accompanying drawings.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

In the figures, dimensions may be exaggerated for clarity of illustration. Like reference numerals refer to like elements throughout.

DETAILED DESCRIPTION

Hereinafter, embodiments of the present invention will be described in detail with reference to the accompanying drawings.

In describing the present invention, if a subject has been well known in the art to which the present invention pertains and/or technical content is not directly related to an embodiment of the present disclosure, descriptions thereof may be omitted. This is to allow the embodiment of the present invention to be clearly understood without obscuring the primary focus of the embodiment of the present disclosure.

Also, elements of the embodiments of the present invention are independently illustrated to show different characteristic functions, and it does not mean that each element is configured as separated hardware or as a single software component. For example, at least two of the respective elements may be incorporated into a single element, or a single element may be divided into a plurality of elements to perform a function, and the integrated embodiment and divided embodiment of the respective elements are included in the scope of the present invention unless it diverts from the essence of the present invention.

Also, some of the elements may be optional, and may be included to merely enhance the performance of the present invention, rather than being essential to perform a constitutional function. Embodiments of the present invention may be implemented by using only the elements requisite for implementing the essence of the present invention, excluding elements used to merely enhance the performance.

In describing embodiments of the present invention, if a detailed description of known techniques associated with the present invention unnecessarily obscures the gist of the present invention, the detailed description thereof may be omitted. Moreover, the terms used henceforth have been defined in consideration of the functions of the present invention, and may be altered according to the intent of a user or operator, or conventional practice. Therefore, the terms should be defined on the basis of the entire content of this specification.

Figure 1A:
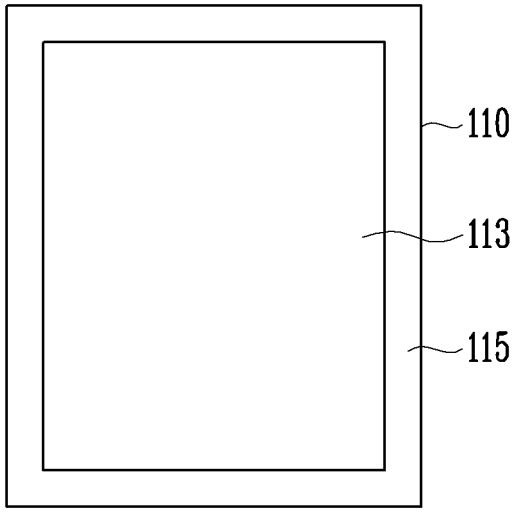
FIGS. 1A-1B are top and perspective views, respectively, illustrating an example of a display panel according to an embodiment of the present invention.
Figure 1B:
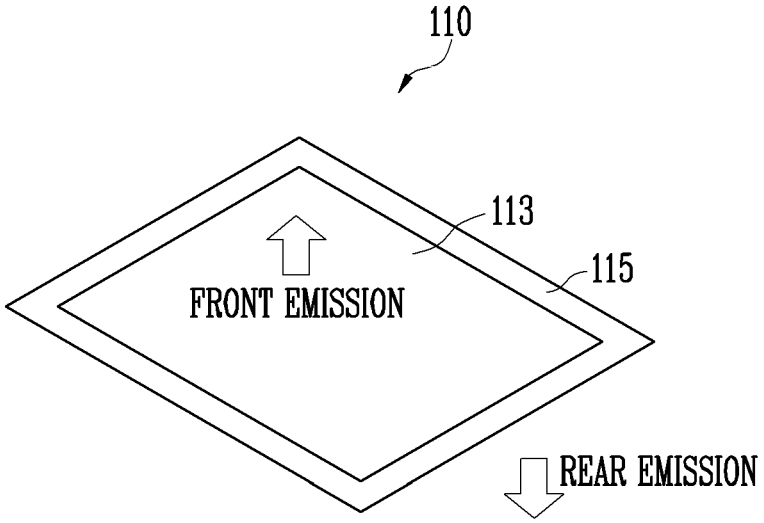

FIGS. 1A and 1B are top and perspective views, respectively, illustrating an example of a display panel according to an embodiment of the present invention.

Referring to FIG. 1A, a display panel 110 may include a front emission panel 113 and a rear emission panel 115. Here, the front emission panel 113 may include a plurality of front emission pixels, and the rear emission panel 115 may include rear emission pixels.

In this case, as illustrated in FIG. 1B, in the front emission panel 113 of the display panel 110, light may be emitted from a front surface of the display panel 110. Also, in the rear emission panel 115 of the display panel 110, light may be emitted from a rear surface of the display panel 110.

Here, as illustrated in FIGS. 1A and 1B, the rear emission panel 115 may be formed on an edge portion of the display panel 110, and the front emission panel 113 may be formed on another region (e.g., a central region) of the display panel 110. According to an embodiment, the rear emission panel 115 may be positioned in a bezel region of the display panel 110, and the front emission panel 113 may be positioned in a display region of the display panel 110, the display region being separate from (e.g., inside of) the bezel region.

For the convenience of explanation, the term of "the front emission panel" and the term of "the front emission region" may be interchangeably used as terms designating a part in which light is emitted to the front surface of the display panel 110. Also, the term of "the rear emission panel" and the term of "the rear emission region" may be interchangeably used as terms designating a part in which light is emitted to the rear surface of the display panel 110.

Figure 2:
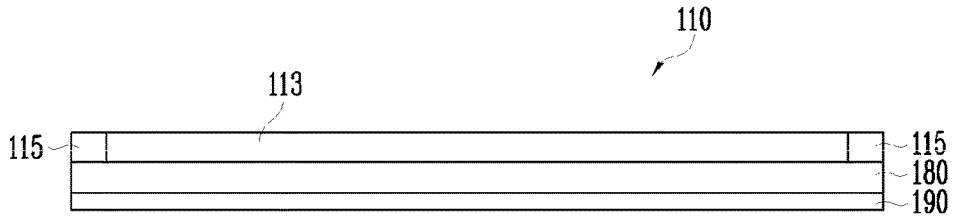
FIG. 2 is a cross-sectional view illustrating an example of a display panel according to an embodiment of the present invention.

FIG. 2 is a cross-sectional view illustrating an example of a display panel according to an embodiment of the present invention.

Referring to FIG. 2, the display panel 110 of the display device according to an embodiment of the present invention may include the front emission panel 113 and the rear emission panel 115. Here, the display panel 110 may further include a diffusion sheet 180 under the front emission panel 113 and the rear emission panel 115, and may also include a reflection plate 190 under the diffusion sheet 180.

In the front emission panel 113, light may be emitted in a forward direction of the display panel 110, that is, in an upward direction of the display panel 110 as shown in FIG. 2. In the rear emission panel 115, light may be emitted in a backward direction of the display panel 110, that is, in a downward direction of the display panel 110 as shown in FIG. 2.

Here, rear light emitted from the rear emission panel 115 may be diffused to the entire region of the display panel 110 by the diffusion sheet 180 positioned under the rear emission panel 115. For example, when the rear emission panel 115 is positioned in the bezel region of the display panel 110, rear light emitted from the rear emission panel 115 may be diffused in the direction of the display region of the display panel 110 by the diffusion sheet 180.

Rear light diffused by the diffusion sheet 180 may be reflected in the upward direction of the display panel 110 by the reflection plate 190 positioned under the diffusion sheet 180, that is, reflected toward the front emission panel 113. That is, rear light emitted from the rear emission panel 115 may be spread to the entire region of the display panel 110 by the diffusion sheet 180, and the diffused rear light may be reflected by the reflection plate 190 to be incident on the front emission panel 113.

Accordingly, rear light incident on the front emission panel 113 may be emitted from at least a portion of a display region of the display panel 110.

Figure 3:
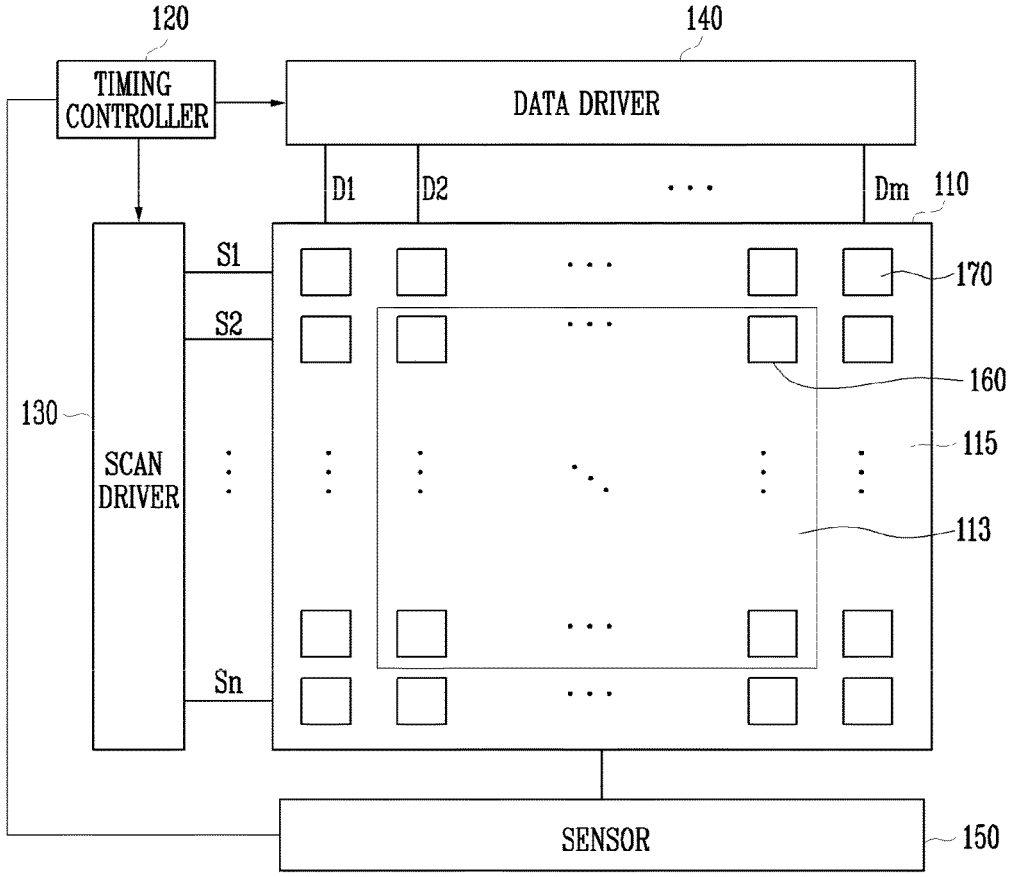
FIG. 3 is a block diagram illustrating an example of a display device according to an embodiment of the present invention.
Figure 4:
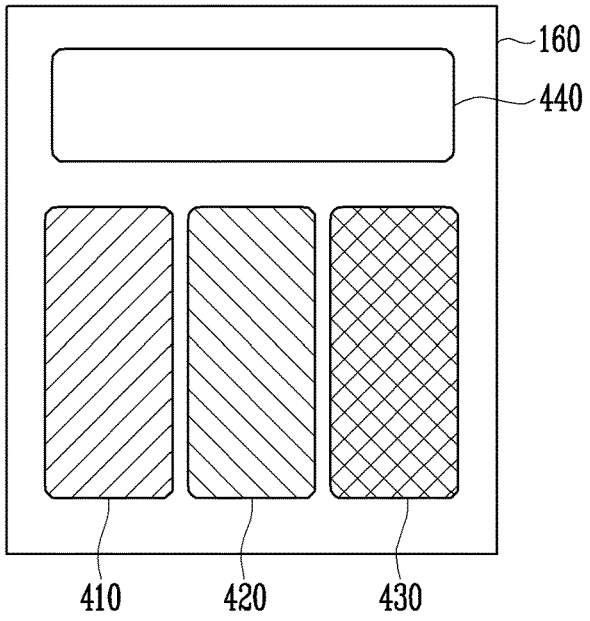
FIG. 4 illustrates an example of a front emission pixel according to an embodiment of the present invention.
Figure 5:
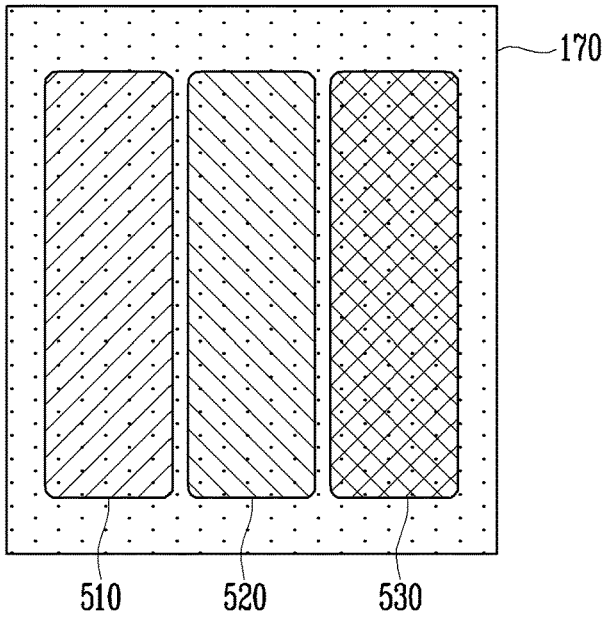
FIG. 5 illustrates an example of a rear emission pixel according to an embodiment of the present invention.
Figure 6:
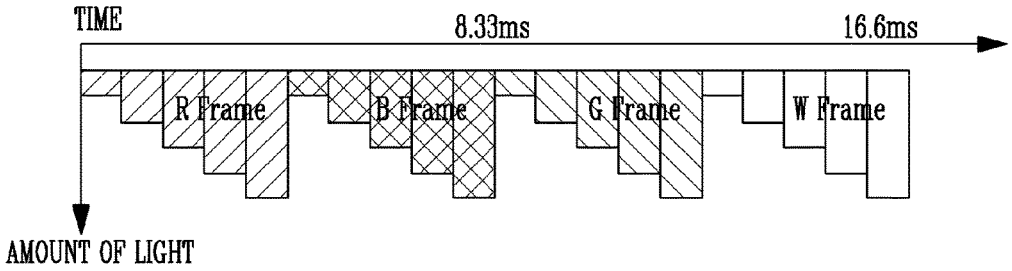
FIG. 6 is a diagram illustrating an example of a driving sequence of a rear emission pixel according to an embodiment of the present invention.

FIG. 3 is a block diagram illustrating an example of a display device according to an embodiment of the present invention; FIG. 4 illustrates an example of a front emission pixel according to an embodiment of the present invention; FIG. 5 illustrates an example of a rear emission pixel according to an embodiment of the present invention; and FIG. 6 is a diagram illustrating an example of a driving sequence of a rear emission pixel according to an embodiment of the present invention.

Referring to FIG. 3, a display device according to an embodiment of the present invention may include the display panel 110 including the front emission panel 113 and the rear emission panel 115, a scan driver 130 for transmitting a plurality of scan signals to the display panel 110, a data driver 140 for transmitting a plurality of data signals to the display panel 110, a power supply for supplying a driving voltage (e.g., a first source voltage and a second source voltage) to the display panel 110, and a timing controller 120 for supplying a plurality of control signals for controlling the scan driver 130, the data driver 140, and the power supply. The display device may further include a sensing unit (e.g., a sensor) 150 for sensing whether or not the pixels 160 and 170 of the display panel 110 are degraded. Although the sensing unit 150 is illustrated as a separate component, the present invention is not limited thereto, and the sensing unit 150 may be included in the timing controller 120 or the data driver 140.

The display panel 110 may include the front emission panel 113 and the rear emission panel 115. Here, the front emission panel 113 may be a panel in which a plurality of front emission pixels 160 are arranged in a matrix form, and each of the front emission pixels 160 may emit light corresponding to a flow of a driving current according to a data signal transmitted from the data driver 140. Here, the front emission pixel 160 may include a light emitting device, such as an organic light emitting diode (OLED). Also, the display device may be classified as a passive matrix OLED (PMOLED) or an active matrix OLED (AMOLED) according to a scheme in which the OLED is driven. In the present embodiment, the display device is an AMOLED.

Also, the rear emission panel 115 may be a panel in which a plurality of rear emission pixels 170 are arranged in a matrix form, and each of the rear emission pixels 170 may emit light corresponding to a flow of a current according to a data signal transmitted from the data driver 140. Here, the rear emission pixel 170 may include a light emitting element, such as an OLED, and/or the like. In the drawing, it is illustrated that the rear emission pixels 170 are arranged as a single column or a single row on the rear emission panel 115 (e.g., at a periphery of the display region, or at the bezel region/edge portion, while having a width of one pixel), but the present invention is not limited thereto. For example, the rear emission pixel 170 may be arranged in two or more columns and/or two or more rows on the rear emission panel 115.

Also, as described above, the rear emission panel 115 may be positioned at the edge region of the display panel, and the front emission panel 113 may be positioned on the other region of the display panel 110. Also, according to an embodiment, the rear emission panel 115 may be positioned in the bezel region of the display panel 110 and the front emission panel 113 may be positioned in the display region, which excludes the bezel region, of the display panel 110.

Referring to FIG. 4, the front emission pixel 160 according to an embodiment of the present invention may include a red subpixel (e.g., a front red subpixel) (R) 410, a green subpixel (e.g., a front green subpixel) (G) 420, a blue subpixel (e.g., a front blue subpixel) (B) 430, and a switching element 440. Here, according to an embodiment, the switching element 440 may be an opening. Also, according to an embodiment, the switching element 440 may be a micro-electromechanical system (MEMS). MEMS refers to an ultra micromachining technology, and to an electromagnetic system of a few nanometers to a few millimeters in scale. The MEMS is an element having only ON/OFF characteristics, such as reflecting or not reflecting, or such as closing or opening a shutter.

Referring to FIG. 5, the rear emission pixel 170 according to an embodiment of the present invention may include a red subpixel (e.g., a rear red subpixel) (R) 510, a green subpixel (e.g., a rear green subpixel) (G) 520, and a blue subpixel (e.g., a rear blue subpixel) (B) 530.

A plurality of scanning lines S1 to Sn are formed in a row direction, and transmit scan signals from the scan driver 130, while a plurality of data lines D1 to Dm are formed in a column direction, which is substantially orthogonal to the row direction, and transmit data signals from the data driver 140. The plurality of scan and data lines cross at the regions where the plurality of pixels 160 and 170 included in the display panel 110 are formed.

That is, the pixels 160 and 170 positioned in a jth pixel row (where j is a natural number) and in a kth pixel column (where k is a natural number), among the plurality of pixels 160 and 170, are connected to one scanning line Sj and one data line Dk corresponding thereto. However, the above is only an example, and the present invention is not limited to the aforementioned configuration and structure. For example, the scan driver 130 may be implemented as a plurality of driving units.

Also, according to an embodiment, the scan driver 130 may include a first scan driver and a second scan driver, and/or the data driver 140 may include a first data driver and a second data driver. The first scan driver may transmit scan signals to the front emission pixels 160, and the second scan driver may transmit scan signals to the rear emission pixels 170. The first data driver may transmit data signals to the front emission pixels 160, and the second data driver may transmit data signals to the rear emission pixels 170.

Each of the pixels 160 and 170 may include a pixel circuit for supplying a current according to a corresponding data signal to the OLED, and the OLED may emit light having a brightness according to the supplied current. Here, a first source voltage and a second source voltage required for an operation of the display panel 110 are transmitted from the power supply.

The scan driver 130 is a circuit for applying a plurality of scan signals to the display panel 110. The scan driver 130 may be connected to the plurality of scan lines S1 to Sn and transmit each of a plurality of scan signals to corresponding scanning lines among the plurality of scanning lines. The scan driver 130 may generate and transmit the scan signals to scan lines connected to rows of the plurality of pixels 160 and 170 included in the display panel 110 according to a scan driving control signal supplied from the timing controller 120.

The data driver 140 may generate a plurality of data signals from a signal including image data transmitted from the timing controller 120, and may transmit the plurality of generated data signals to the plurality of data lines D1 to Dm connected to the display panel 110. Driving of the data driver 140 is operated by (e.g., controlled by) a data driving control signal supplied from the timing controller 120.

The timing controller 120 may receive, for example, a timing signal, such as a horizontal synchronization signal, a vertical synchronization signal, a data enable signal, and a dot clock. The timing controller 120 may generate control signals to be transmitted to each of the data driver 140, the scan driver 130, and the power supply by using the received signals.

The sensing unit 150 may extract degradation information of a plurality of pixels 160 and 170 included in the display panel 110. Here, the sensing unit 150 may extract degradation information of the OLED included in each of the front emission pixels 160 included in the front emission panel 113. Also, according to an embodiment, the sensing unit 150 may extract degradation information of the OLED included in each of the front emission pixels 160 during a preset sensing period.

Also, the sensing unit 150 may extract degradation information of each of the red subpixel (R) 410, the green subpixel (G) 420, and the blue subpixel (B) 430 included in each of the front emission pixels 160. That is, the sensing unit 150 may sense whether or not a specific subpixel, among the subpixels R, G, and B 410, 420, and 430 included in the front emission pixels 160, is degraded.

The sensing unit 150 may transmit the degradation information of each of the front emission pixels 160 to the timing controller 120. The timing controller 120 may control emission of the front emission pixels 160 and the rear emission pixels 170 according to the received degradation information of the front emission pixels 160. That is, when any one of the subpixels 410, 420, and 430 included in the front emission pixel 160 is degraded, the sensing unit 150 senses it, and the timing controller 120 may reinforce a degraded light source in the corresponding front emission pixel 160 by using the switching element 440 included in the front emission pixel 160.

In detail, for example, specific similarly/commonly colored subpixels, or a color category of the subpixels, of all of the front emission pixels 160 included in the front emission panel 113 may all be degraded. For example, all of the green subpixels 420 of all of the front emission pixels 160 may be degraded. Here, the sensing unit 150 may sense the information indicating that the green subpixels 420 of all of the front emission pixels 160 are degraded, and may sense information indicating a degree to which the green subpixels 420 are degraded.

Accordingly, to compensate the degradation, the timing controller 120 may control the green subpixels 520 of the rear emission pixel 170 included in the rear emission panel 115 (e.g., may control the green subpixels 520 to emit light by a preset amount during a preset period of time). For example, the timing controller 120 may control the green subpixel 520 of the rear emission pixel 170 to emit light by a preset amount during a preset period of time of one frame period according to a degradation degree of the green subpixels 420 of the front emission pixels 160. Here, according to an embodiment, as the degradation degree of the green subpixels 420 of the front emission pixels 160 becomes greater, the amount of light of the green subpixel 520 of the rear emission pixel 170 may be increased, or a light emission time may be lengthened.

The timing controller 120 may turn on (i.e., open) the switching element 440 included in the front emission pixel 160 during the period of time in which the green subpixel 520 of the rear emission pixel 170 emits light. Here, green rear light emitted from the rear emission pixel 170 is diffused and reflected through the diffusion sheet 180 and the reflection plate 190 that are positioned under the front emission panel 113, and is emitted through the open switching element 440 of the front emission pixel 160. Thus, the degraded green light of the green subpixel 420 of the front emission pixel 160 may be reinforced/compensated.

Here, because the green subpixels 420 of all of the front emission pixels 160 included in the front emission panel 113 are degraded, the timing controller 120 may open all of the switching elements 440 of the front emission pixels 160 included in the front emission panel 113 during a period of time in which the green subpixel 520 of the rear emission pixel 170 emits light. Also, according to an embodiment, when the switching element 440 is an opening, the green subpixel 520 of the rear emission pixel 170 may emit by a preset amount during a preset period of time, without controlling the front emission pixel 160, whereby the degradation of the green subpixels 420 of all of the front emission pixels 160 may be compensated.

When the red subpixels 410 of all of the front emission pixels 160 included in the front emission panel 113 are all degraded, or when the blue subpixels 430 of all of the front emission pixels 160 are degraded, the degraded light source may be compensated according to the similar method. For example, the timing controller 120 may control the red subpixel 510 or the blue subpixel 530 of the rear emission pixel 170 to emit light (e.g., during a preset period of time of one frame period by a preset amount) according to a degree of degradation of the red subpixels 410 of the front emission pixels 160, or according to a degree of degradation of the blue subpixels 430 of the front emission pixels 160. The timing controller 170 may open the switching elements 440 of the front emission pixels 160 during the emission period of the red subpixel 510 or the blue subpixel 530 of the rear emission pixel 170. By doing so, the degradation of the red subpixels 410 or blue subpixels 430 of all of the front emission pixels 160 may be compensated.

Also, two or more subpixels of all of the front emission pixels 160 may be degraded. For example, the red subpixels 410 and the green subpixels 420 of all of the front emission pixels 160 may be degraded. In this case, the timing controller 120 may control the corresponding subpixels (i.e., the red subpixel 510 and the green subpixel 520) of the rear emission pixel 170 in a manner corresponding to the degraded light sources to emit light during a preset period of time of one frame period by a preset amount. Also, the timing controller 120 may open the switching element 440 of each of the front emission pixels 160 during an emission period of each of the red subpixel 510 and the green subpixel 520 of the rear emission pixel 170. By doing that, degradation of the at least two subpixels of all of the front emission pixels 160 may be compensated.

Thereafter, specific subpixels 410, 420, and 430 of the specific front emission pixel 160 among the front emission pixels 160 included in the front emission panel 113 may be degraded. For example, the red subpixel 410 of a first front emission pixel may be degraded. The sensing unit 150 may sense the information indicating that the red subpixel 410 of the first front emission pixel is degraded, and may also sense information indicating a degree to which the red subpixel 410 is degraded.

Thus, the timing controller 120 may control the red subpixel 510 of the rear emission pixel 170 included in the rear emission panel 115 to emit light by a preset amount during a preset period of time. For example, the timing controller 120 may control the red subpixel 510 of the rear emission pixel 170 to emit light for a preset period of time of one frame period by a preset amount according to the degree of the degradation of the red subpixel 410 of the first front emission pixel. Here, according to an embodiment, as the degree of degradation of the red subpixel 410 of the first front emission pixel increases, the amount of light emitted by the red subpixel 510 of the rear emission pixel 170 may be increased, or an emission time of the red subpixel 510 may be lengthened The timing controller 120 may turn on/open the switching element 440 included in the first front emission pixel during a period in which the red subpixel 510 of the rear emission pixel 170 emits light. Here, red light/red rear light emitted from the rear emission pixel 170 is diffused and reflected through the diffusion sheet 180 and the reflection plate 190, which are beneath the front emission panel 113, and is emitted through the opened switching element 440 of the first front emission pixel. Thus, the degraded red light of the red subpixel 420 of the first front emission pixel may be reinforced, and the degradation may be compensated.

According to an embodiment, the rear emission pixel 170 may emit light by a preset amount during a preset period of time in each of the subpixels 510, 520, and 530 during one frame period, as illustrated in FIG. 6.

For example, as illustrated in FIG. 6, in the rear emission pixel 170, the red subpixel 510 may emit light during a preset first period by a first amount during a first period, or a first frame period (a frame being illustrated as 16.6 ms in the drawing, although the present invention is not limited thereto), may emit light by a second amount during a second period, may emit light by a third amount during a third period, may emit light by a fourth amount during a fourth period, and may emit light by a fifth amount during a fifth period.

Also, as an example, the blue subpixel 530 may emit light by a first amount during a preset sixth period, by a second amount during a seventh period, by a third amount during an eighth period, by a fourth amount during a ninth period, and by a fifth amount during a tenth period.

Similarly, the green subpixel 520 may emit light by first to fifth amounts during preset eleventh to fifteenth periods, respectively.

Also, as illustrated, the rear emission pixel 170 may emit white light by a preset amount during preset periods, according to an embodiment.

In the drawing, it is illustrated that light is emitted by dividing the amounts of red, green, blue, and white light into respective first to five stages, but the present invention is not limited thereto, and the stages of the light amounts may be greater or fewer by colors according to a display device. Also, an order of light emission of red, blue, green, and white light may be different from that of the drawing.

In this case, the timing controller 120 may receive information indicating that a specific subpixel (e.g., the red subpixel 410) of the first front emission pixel is degraded, and information regarding a degree of degradation thereof.

Here, the timing controller 120 may determine a required amount of light of a red light source according to the degree of degradation of the red subpixel 410 of the first front emission pixel. For example, the timing controller 120 may determine that a second amount of red light is required to compensate for degradation of the red subpixel 410 of the first front emission pixel. Thus, the timing controller 120 may turn on, that is, open, the switching element 440 included in the first front emission pixel during the second period in which the rear emission pixel 170 emits red light by the second amount.

The timing controller 120 may receive information indicating that the blue subpixel 430 of a second front emission pixel is degraded, and may receive information indicating a degree of the degradation. The timing controller 120 may determine that a fifth amount of blue light is further required to compensate for the degradation of the blue subpixel 430 of the second front emission pixel. Thus, the timing controller 120 may open the switching element 440 included in the second front emission pixel during a tenth period in which the rear emission pixel 170 emits blue light by a fifth amount.

Also, in a case where the green subpixel 420 of the third front emission pixel is degraded so that a third amount of green light is required, the timing controller 120 may open the switching element 440 included in the third front emission pixel during a thirteenth period in which the rear emission pixel 170 emits green light by a third amount, for example.

In this manner, the timing controller 120 may receive information regarding the front emission pixel having the degraded subpixels 410, 420, and 430 among the front emission pixels 160, and information regarding a degree of degradation from the sensing unit 150. Also, while the rear emission pixel 170 emits light by an amount of suitable color to compensate for the degraded light source of the degraded subpixels, the timing controller 120 may compensate for the degraded light source by opening the switching element 440 of the corresponding front emission pixel.

According to an embodiment, the scan driver 130, the data driver 140, the timing controller 120, and the sensing unit 150 may be implemented in a single display driver IC as hardware. Also, the timing controller 120 may operate as a control unit (e.g., a controller) for controlling a general operation of the display device.

To display an image, each of the plurality of pixels 160 and 170 included in the display panel 110 may receive a scan signal, and may emit light at the OLED with a data voltage corresponding to a data signal.

Figure 7A:
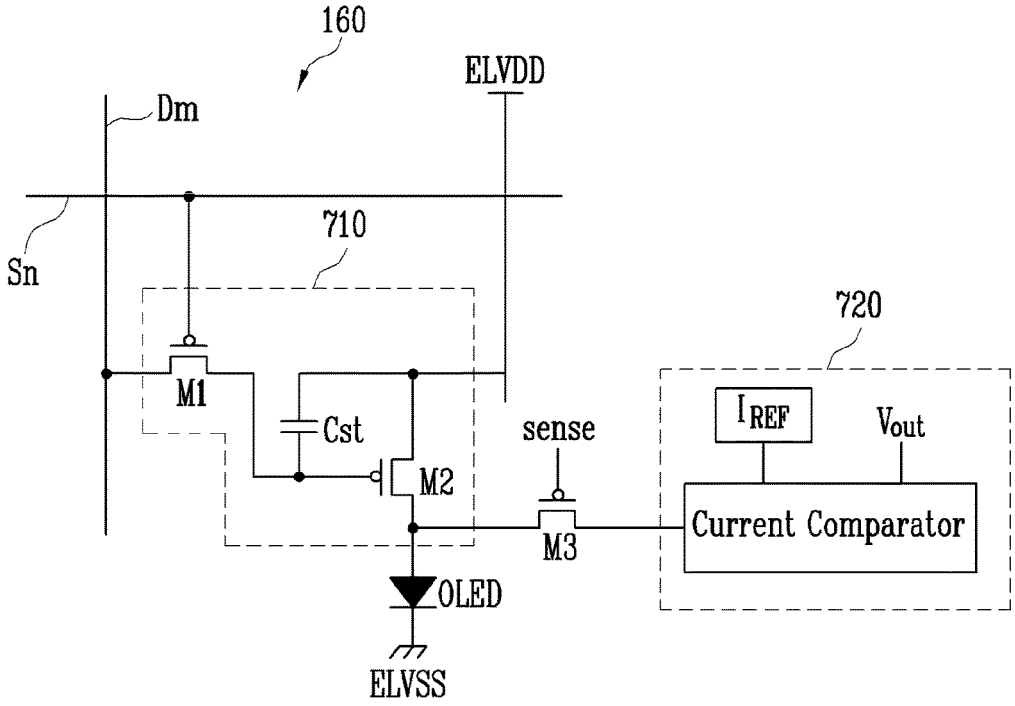
FIGS. 7A-7B are schematic diagrams illustrating examples of a front emission pixel and a sensing unit according to an embodiment of the present invention.
Figure 7B:
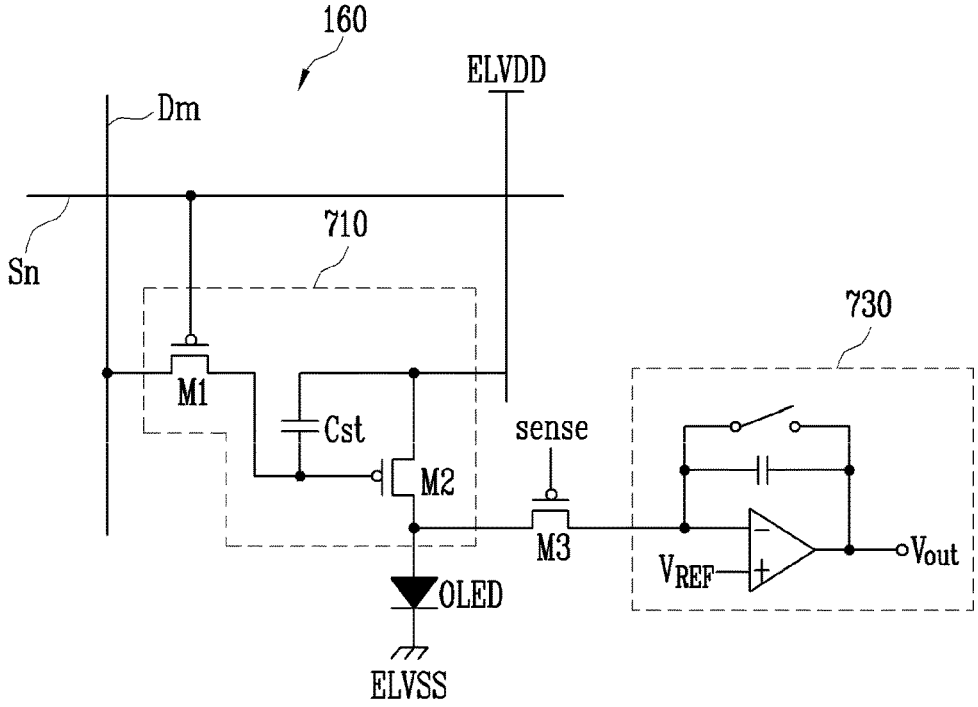

FIGS. 7A and 7B are schematic diagrams illustrating examples of a front emission pixel and of a sensing unit according to an embodiment of the present invention.

Referring to FIGS. 7A and 7B, the front emission pixel 160 of the display device according to an embodiment of the present invention may include an OLED and a pixel circuit 710 connected to a data line Dm and a scan line Sn to control the OLED.

An anode electrode of the OLED may be connected to the pixel circuit 710, and a cathode electrode of the OLED may be connected to a second power source ELVSS. The OLED may emit light with brightness corresponding to a current supplied from the pixel circuit 710.

The pixel circuit 710 may control an amount of current supplied to the OLED in response to a data signal supplied to the data line Dm when a scan signal is supplied to the scan line Sn.

To this end, the pixel circuit 710 may include a second transistor M2 connected between a first power source ELVDD and the OLED, a first transistor M1 connected between the second transistor M2 and the data line Dm/the scan line Sn, and a storage capacitor Cst connected between a gate electrode of the second transistor M2 and a first electrode of the second transistor M2.

A gate electrode of the first transistor M1 is connected to the scan line Sn, and a first electrode of the first transistor M1 is connected to the data line Dm. A second electrode of the first transistor M1 is connected to one terminal of the storage capacitor Cst.

Here, the first electrode of the first transistor M1 may be a source electrode or a drain electrode, and the second electrode of the first transistor M1 is set as an electrode that is different from the first electrode of the first transistor M1. For example, when the first electrode is a source electrode, the second electrode is a drain electrode. When a scan signal is supplied from the scan line Sn, the first transistor M1 connected to the scan line Sn and to the data line Dm is turned on to supply a data signal supplied from the data line Dm to the storage capacitor Cst. Here, the storage capacitor Cst charges a voltage corresponding to the data signal.

The gate electrode of the second transistor M2 is connected to one terminal of the storage capacitor Cst, and the first electrode of the second transistor M2 is connected to the other terminal of the storage capacitor Cst and to the first power source ELVDD. The second electrode of the second transistor M2 is connected to an anode electrode of the OLED.

The second transistor M2 controls an amount of a current flowing to the second power source ELVSS by way of the OLED from the first power source ELVDD in response to a voltage value stored in the storage capacitor Cst. Here, the OLED may generate light corresponding to the amount of current supplied from the second transistor M2.

The pixel circuit 710 described above is only an example, and may be connected to the OLED, to the data line Dm, and to the scan line Sn to be configured as a different circuit for controlling the OLED.

Referring to FIG. 7A, the display device according to an embodiment of the present invention may further include the sensing unit 150 for sensing a degree of degradation of the front emission pixel 160. Here, as illustrated in FIG. 7A, a first electrode of a third transistor M3 may be connected between the OLED and the second transistor M2 of the front emission pixel 160. Here, a gate electrode of the third transistor M3 may be connected to a sensing control line to receive a sensing control signal. Thus, when the sensing control signal is received, the third transistor M3 may extract degradation information of the corresponding front emission pixel 160.

A second electrode of the third transistor M3 may be connected to a monitor unit (e.g., a monitor) 720 included in the sensing unit 150. The monitor unit 720 may measure a current flowing when a voltage is applied to the driving transistor M2, and may compare the measured current with a reference current value ($I_{REF}$). The monitor unit 720 may convert the comparison value into a voltage (e.g., a set or predetermined voltage) Vout (or into a current), and may output the converted voltage (or current) as degradation information. The monitor unit 720 may apply a current to the OLED, and may measure a voltage according to the current to extract degradation information of the corresponding front emission pixel 160.

Also, referring to FIG. 7B, the display device according to an embodiment of the present invention may further include a sensing unit 150 for sensing a degree of degradation of the front emission pixel 160. Here, as illustrated in FIG. 7B, the first electrode of the third transistor M3 may be connected between the OLED and the second transistor M2. Here, a gate electrode of the third transistor M3 may be connected to a sensing control line to receive a sensing control signal. Thus, when the sensing control signal is received, the third transistor M3 may extract degradation information of the corresponding front emission pixel 160.

The second electrode of the third transistor M3 may be connected to a monitor unit (e.g., a monitor) 730 included in the sensing unit 150. The monitor unit 730 may measure a current flowing when a voltage is applied to the driving transistor M2. The monitor unit 730 applies a voltage to the OLED, and measures a current according to the voltage to extract degradation information of the corresponding front emission pixel 160.

The monitor units 720 and 730 included in the sensing unit 150 illustrated in FIGS. 7A and 7B are only examples, and the present invention is not limited thereto. Any suitable component for extracting degradation information of the front emission pixels 160 may be included in the sensing unit 150. For example, an optical sensing unit using a CMOS camera may be included in the sensing unit 150.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein, such as the timing controller, the scan and data drivers, and the sensor, may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and equivalents thereof.

What is claimed is:

1. A display device comprising:
a display panel comprising:
a plurality of front emission pixels each comprising a switching element; and
a rear emission pixel;
a sensor configured to:
sense whether the front emission pixels are degraded; and
generate degradation information; and
a controller configured to:
compensate for a degraded light source of a degraded front emission pixel of the front emission pixels according to the degradation information; and
control an ON/OFF state of the switching element of the degraded front emission pixel according to the degradation information,
wherein the rear emission pixel comprises:
a red subpixel;
a green subpixel; and
a blue subpixel, and
wherein the controller is configured to control emission of light from at least one subpixel of the rear emission pixel according to the degradation information.

2. The display device of claim 1, wherein the controller is configured to control the switching element of the degraded front emission pixel during a period in which the rear emission pixel emits light.

3. The display device of claim 1, wherein the controller is configured to control the switching element of the degraded front emission pixel during a period in which a subpixel of the rear emission pixel emits light by an amount of color for compensating the degradation of the degraded front emission pixel according to the degradation information.

4. The display device of claim 1, wherein the switching element comprises a micro electromechanical system (MEMS).

5. A display device comprising:
a display panel comprising:
a plurality of front emission pixels each comprising a switching element; and
a rear emission pixel;
a sensor configured to:
sense whether the front emission pixels are degraded; and
generate degradation information; and
a controller configured to:
compensate for a degraded light source of a degraded front emission pixel of the front emission pixels according to the degradation information; and
control an ON/OFF state of the switching element of the degraded front emission pixel according to the degradation information,
wherein the display panel comprises:
a front emission panel comprising the front emission pixels;

a rear emission panel comprising the rear emission pixel;

a diffusion sheet under the front emission panel and the rear emission panel; and a reflection plate under the diffusion sheet.

6. The display device of claim 1, wherein the switching element defines an opening, and wherein, when subpixels of the front emission pixels are all degraded, the controller is configured to control light emission of a subpixel of the rear emission pixel corresponding to the subpixels of the front emission pixels.

7. The display device of claim 1, wherein the degradation information comprises:

information regarding the degraded front emission pixel; and information regarding a degree of degradation of the degraded front emission pixel.

8. The display device of claim 1, wherein each of the front emission pixels further comprises an organic light emitting diode (OLED).

9. A method of driving a display device comprising a plurality of front emission pixels that are configured to emit light toward an upper side of a display and that comprise a switching element configured to control a passage of light, and also comprising a rear emission pixel configured to emit light to a lower side of the display, the method comprising:

sensing degradation information of the front emission pixels;

controlling light emission of the rear emission pixel to correspond to the degradation information; and controlling an ON state or an OFF state of the switching element according to the sensed degradation information.

10. The method of claim 9, wherein the sensing of the degradation information comprises sensing degradation information of an OLED in each of a front red subpixel, a front green subpixel, and a front blue subpixel of the front emission pixels.

11. The method of claim 10, wherein the controlling of the light emission of the rear emission pixel comprises enabling at least one of a rear red subpixel, a rear green subpixel, and a rear blue subpixel of the rear emission pixel to emit light corresponding to the sensed degradation information.

* * * * *